US005769666A

United States Patent [19]

Wu

[11] Patent Number: 5,769,666

[45] Date of Patent: Jun. 23, 1998

[54] FILTERED CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 773,609

[22] Filed: Dec. 27, 1996

[51] Int. Cl.[6] ..... H01R 13/66

[52] U.S. Cl. ..... 439/620; 439/607

[58] Field of Search ..... 439/620, 607

[56] References Cited

U.S. PATENT DOCUMENTS

| | | | |
|---|---|---|---|
| 4,641,907 | 2/1987 | Althouse et al. | 439/620 |
| 4,902,242 | 2/1990 | Davis et al. | 439/607 |
| 5,213,522 | 5/1993 | Kojima | 439/620 |
| 5,246,389 | 9/1993 | Briones | 439/620 |
| 5,257,950 | 11/1993 | Lenker et al. | 439/620 |

*Primary Examiner*—Neil Abrams
*Assistant Examiner*—Katrina Davis

[57] ABSTRACT

An electrical filtered connector (10) comprises a unitary housing (12) defining a cavity (14) for receiving a complementary connector therein. A plurality of horizontal passageways (18) are disposed in the housing (12) lengthwise for receiving a corresponding number of contacts (20) therein. A plurality of vertical apertures (28) are disposed corresponding to and communicative to the passageways (18) respectively for receiving a corresponding number of capacitors (32) therein. A holding shell (36) is inserted into the housing (12) to protectively retain the capacitors (32) in the corresponding apertures (28), respectively. An internal shield (50) is inserted into the cavity (14) for shielding the housing (12) and cavity (14) and maintaining the holding shell (36) in position in the housing (12).

18 Claims, 3 Drawing Sheets

FILTERED CONNECTOR

BACKGROUND OF THE INVENTION

1. Field of The Invention

The invention relates to electrical connector assemblies, and particularly to the electrical connector with capacitor elements for filtering EMI (Electro-Magnetic Interference) or RFI (Radio Frequency Interference).

2. The Related Art

Plural capacitor elements being used within an electrical connector for the filter purpose, becomes popular in the computer field, for example, U.S. Pat. Nos. 4,884,982, 4,929,196, 5,102,354, 5,112,253, 5,151,054, 5,213,522, 5,224,878, 5,246,389, and 5,326,280. This invention also relates to U.S. Pat. Nos. 5,158,482 and 5,221,215 which have the same assignee with the invention.

Basically speaking, such type filtered connector is designed to have each capacitor corresponding to each of the contacts in the connector. Therefore, how to develop a simpler and lower cost structure for implementing this requirement, is the key point for the manufacturer.

Therefore, an object of the invention is to provide an electrical filtered connector having a simple one-piece housing receiving therein a plurality of capacitors wherein the whole connector can be assembled easily.

SUMMARY OF THE INVENTION

According to an aspect of the invention, an electrical filtered connector comprises a unitary housing defining a cavity for receiving a complementary connector therein. A plurality of horizontal passageways are disposed in the housing lengthwise for receiving a corresponding number of contacts therein. A plurality of vertical apertures are disposed corresponding to and communicative to the passageways, respectively for receiving a corresponding number of capacitors therein. A holding shell is inserted into the housing to protectively retain the capacitors in the corresponding apertures, respectively. An internal shield is inserted into the cavity for shielding the housing and maintaining the holding shell in position in the housing.

DETAILED DESCRIPTION OF THE PREFERRED EMBODIMENTS

Figure 1:
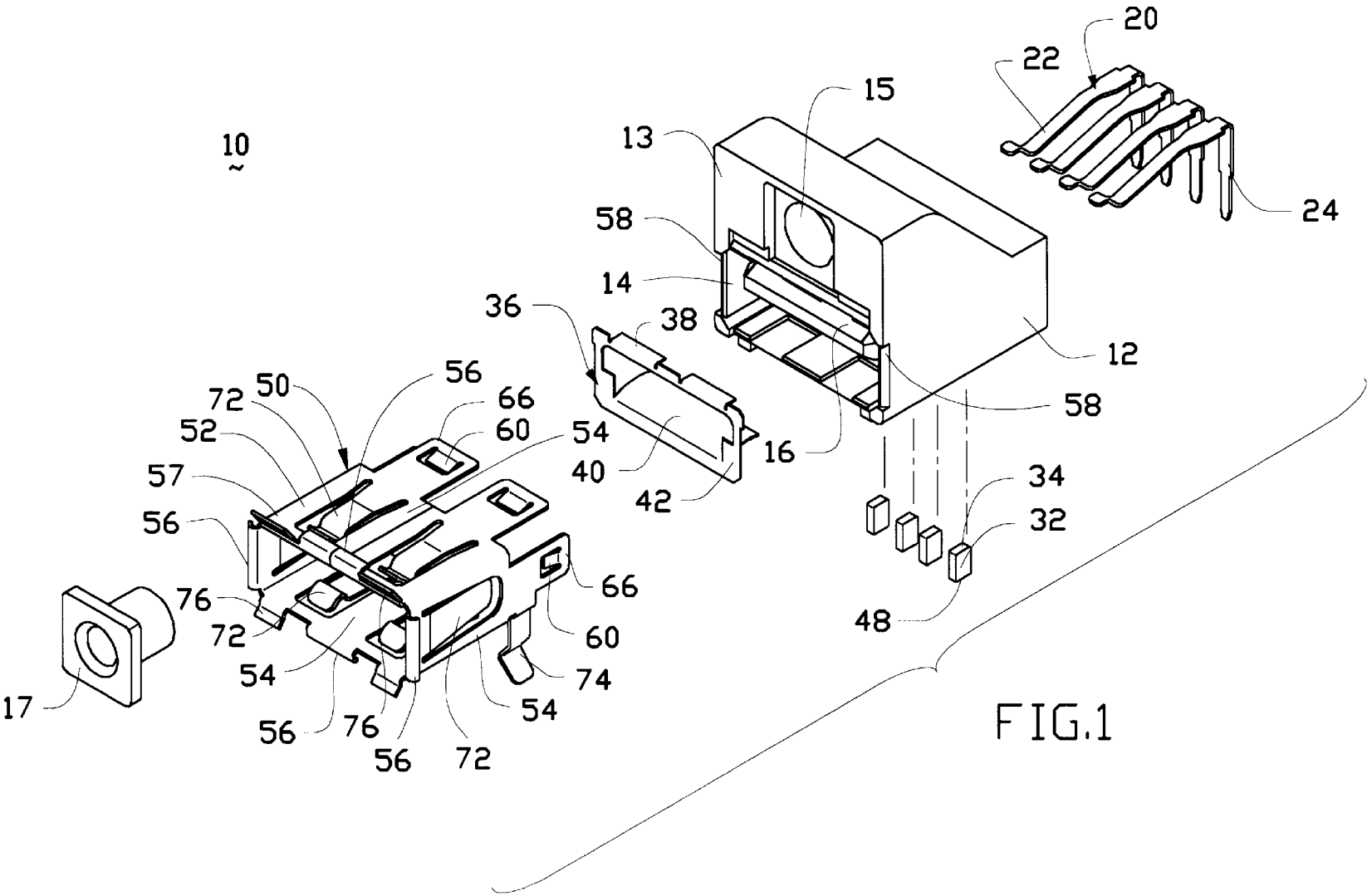
FIG. 1 is an exploded front top perspective view of the present preferred embodiment of a filtered connector according to the invention.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments.

Figure 2:
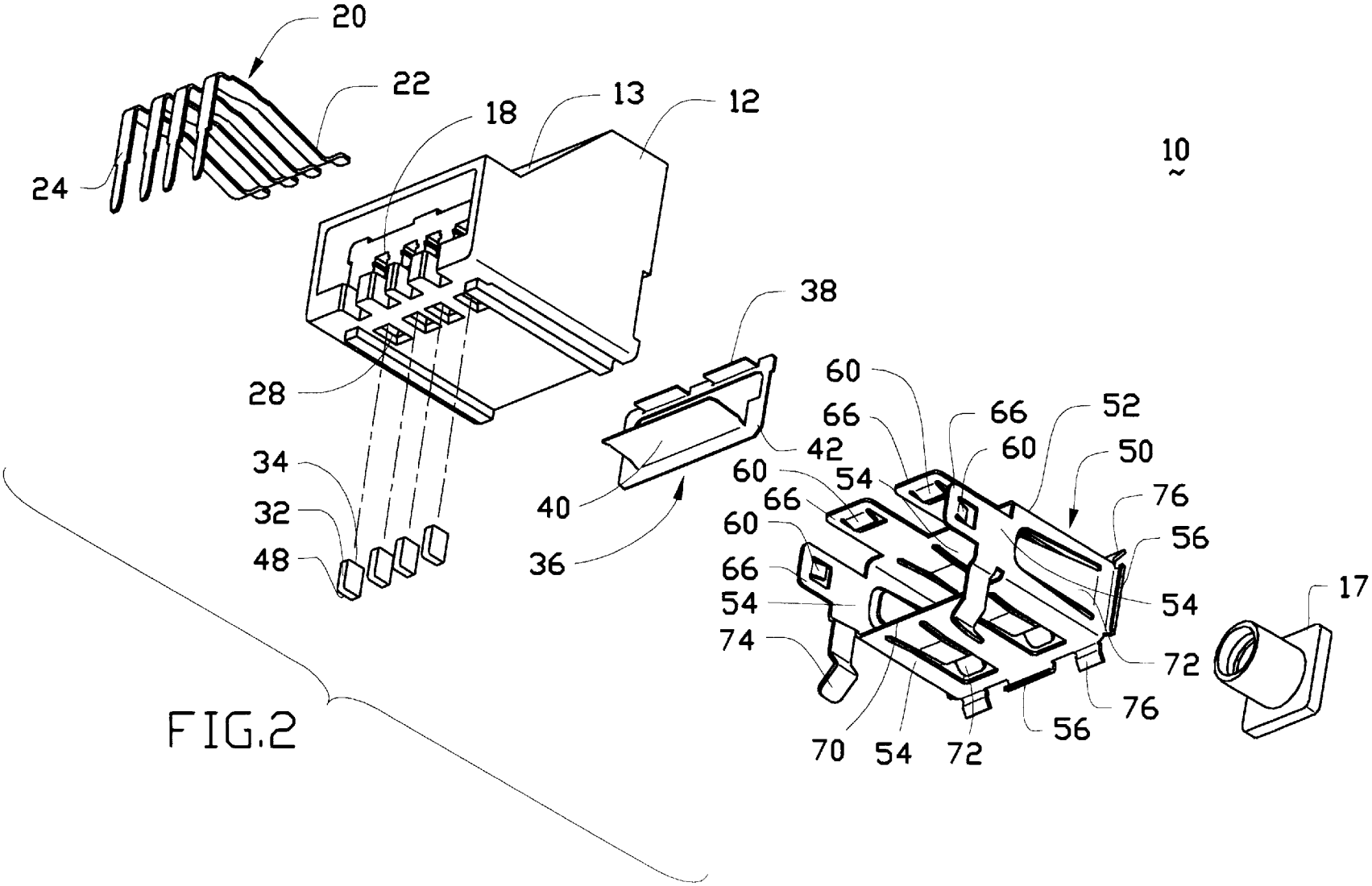
FIG. 2 is an exploded back bottom perspective view of the filtered connector of FIG. 1.
Figure 3:
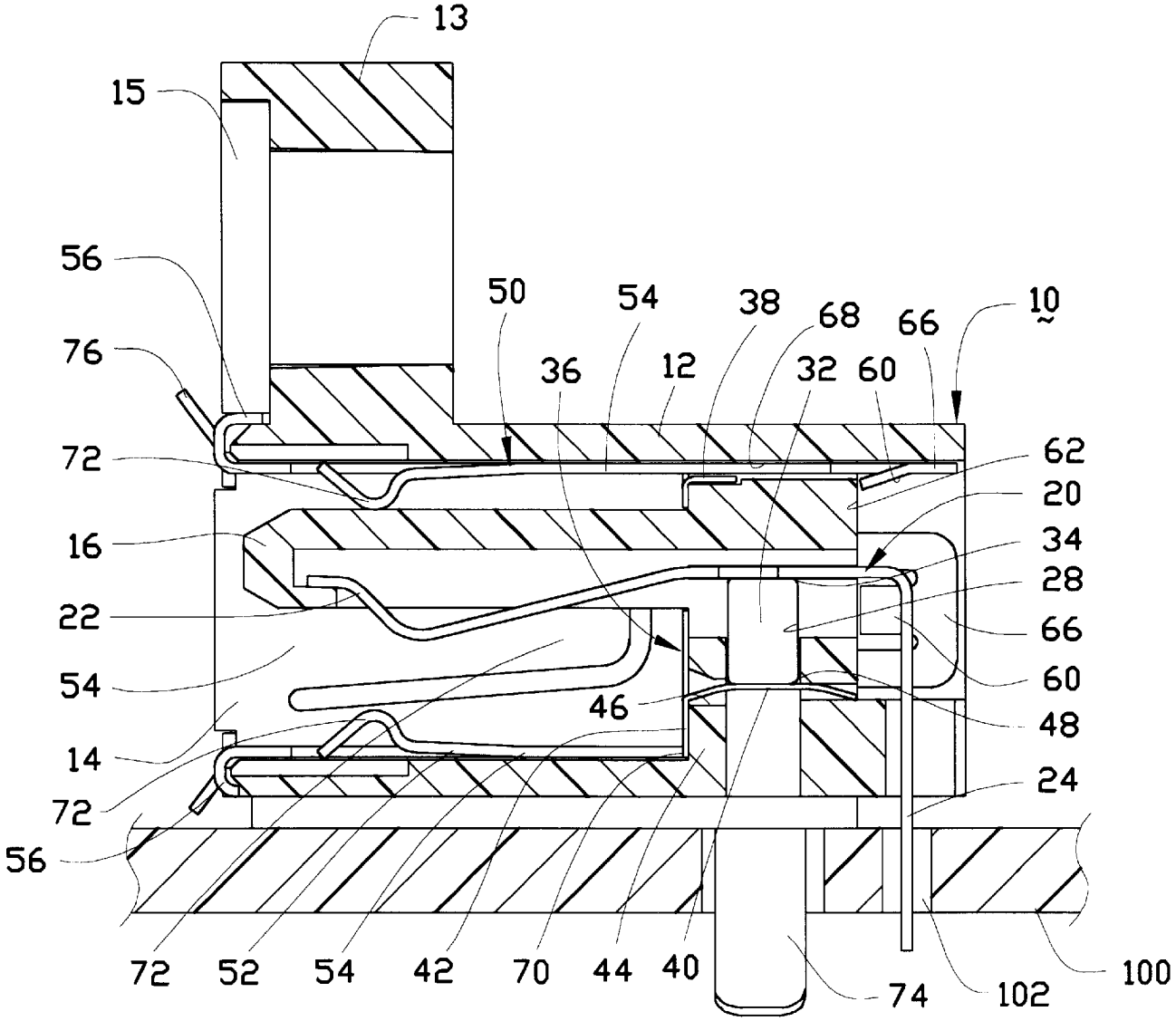
FIG. 3 is a cross-sectional view of the filtered connector of FIG. 1.

Attention is directed to FIGS. 1–3 wherein an electrical filtered connector 10 includes an insulative unitary housing 12 defining a cavity 14 for receiving a complementary connector (not shown) therein. A platform 16 is formed in the cavity 14 for engagement with a front portion of the complementary connector. A plurality of horizontal passageways 18 are lengthwise disposed in the housing 12 for receiving therein a corresponding number of contacts 20 wherein the distal end 22 of each contact 20 extends into the cavity 14 along the platform 16. The tail 24 of each contact 20 extends through a corresponding hole 102 of the PC board 100.

Corresponding to each passageway 18, an aperture 28 vertically extends upward from the under-surface 30 of the housing 12 so that a capacitor 32 can be upward inserted into the corresponding aperture 28 from the bottom until the top end 34 of the capacitor 32 confronts the corresponding contact 20.

Successively, a hollow holding shell 36 including upper horizontally extending sections 38 and a lower horizontally extending section 40, is inserted into the cavity 14 from the front side of the housing 12 until the vertical section 42 of the holding shell 36 abuts against the vertical wall 44 of the housing 12. Under this situation, the lower horizontally extending section 40 can be snugly received within a corresponding slit 46 in the housing 12 and properly pushes the bottom ends 48 of the capacitors 32 and holds the capacitors 32 in position in the corresponding apertures 28, respectively.

Finally, an internal shielding 50 is inserted into the cavity 14 from the front side of the housing 12. The shielding 50 comprises a closed-type circumferential section 52 formed by four walls 54 wherein each wall 54 has a backward folded tip 56 on the front portion 57 for reception within a corresponding recess 58 in the front portion of the housing 12. Each of the top and two side walls 54 further includes at least one rearward extension 66 adapted to be received within the corresponding slots 68 of the housing 12 (only one shown aside the top wall 54) wherein a lance section 60 of each extension 66 of the walls 54 is formed on the rear for latchable engagement with the rear portion 62 of the housing 12. Therefore, the shielding 50 can be retained within the housing 12 without moving relative to the housing 12 wherein the backward folded tips 56 and the lance sections 60 prevent the back-and-forth movement of the shielding 50, and the circumferential section 52 is constrained in the cavity 14 of the housing 12 for preventing any transverse movements of the shielding 50. Under this condition, the vertical section 42 of the holding shell 36 can be pressed against by the rear edge 70 of the bottom wall 54 of the internal shielding 50 so as to be retained within the housing 12 without lengthwise relative movement to the housing 12. On the other hand, the vertical section 42 of the holding shell 36 confined in the cavity 14 and the upper horizontally extending sections 38 and the lower horizontally extending section 40 being received within the corresponding recession or slit 46, prevent any transverse movement of the holding shell with regard to the housing 12. Because the holding shell 36 and the internal shielding 50 are both securely retained in the housing 12, the grounding effect can be reliably and efficiently implemented through the engagement between the rear edge 70 of the bottom wall 54 of the internal shielding 50 and the vertical section 42 of the holding shell 36, and the engagement between the upper horizontally extending sections 38 and the top wall 54 of the internal shielding 50.

The internal shielding 50 further includes tangs 72 inwardly extending for engagement with the external shielding of the complementary connector (not shown) and board-locks 74 for mounting on the PC board 100. Two pairs of guiding leaves 76 are formed on the front edge of the top wall 54 or the bottom wall 54 for guidance of mating of the connector 10 and the complementary connector (not shown).

The housing 12 further includes a mounting ear section 13 having a hole 15 therein for cooperation with a screw nut 17 for mounting to the backpanel of the computer case (not shown).

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. An electrical filtered connector comprising:

an insulative housing defining a cavity with a platform horizontally extending therein;

a plurality of horizontal passageways disposed lengthwise in the housing for receiving a corresponding number of contacts therein;

a plurality of vertical apertures upward extending from an under-surface of the housing corresponding to and communicative to the corresponding passageways, respectively, for receiving therein a corresponding number of capacitors wherein a first end of each of said capacitors abuts against the corresponding contact;

a holding shell including at least a lower horizontal section wherein the horizontal section presses against a second end of each capacitor for holding the capacitors in position in the corresponding apertures, respectively; and an internal shielding including a circumferential section for shielding the cavity and means for abutment with the holding shell for retaining the holding shell in position in the housing.

2. The filtered connector as defined in claim 1, wherein a vertical section of said holding shell is positioned between a vertical wall of the housing and a rear edge of a bottom wall of internal shielding.

3. The filtered connector as defined in claim 1, wherein the internal shielding comprises a closed-type circumferential section formed by a top wall, two side walls and a bottom wall, and wherein some of the top wall and two side walls have rear extensions each with a lance for extending into a corresponding slot in the housing.

4. The filter connector as defined in claim 1, wherein the internal shielding comprises a closed-type circumferential section formed by a top wall, two side walls and a bottom wall, and wherein some of said walls have backward folded tips each for reception within a corresponding recess in the housing.

5. The filter connector as defined in claim 1, wherein the internal shielding comprises guiding leaves on a front portion thereof.

6. The filter connector as defined in claim 1, wherein the internal shielding comprises tangs inward extending into the cavity.

7. A filtered connector comprising:

an insulative housing defining a plurality of horizontal passageways for correspondingly receiving a plurality of contacts therein;

a plurality of apertures disposed perpendicular to the corresponding passageways, respectively, for receiving a plurality of capacitors therein;

a holding shell inserted into the housing for retainably holding the capacitors in position in the corresponding apertures;

a shielding inserted into the housing for retainably maintaining the holding shell in position in the housing.

8. The filtered connector as defined in claim 7, wherein said housing defines a cavity and the holding shell and the shielding both are inserted into said cavity of the housing from a front side of the housing.

9. The filtered connector as defined in claim 8, wherein the shielding comprises a closed-type circumferential section formed by four walls for shielding the cavity.

10. A filtered connector comprising:

an insulative housing defining a cavity therein;

a plurality of horizontal passageways disposed lengthwise in the housing for receiving a corresponding number of contacts therein;

a plurality of apertures upward extending corresponding to and communicative to the corresponding passageways, respectively, for receiving a corresponding number of capacitors therein;

a holding shell holding the capacitors in position in the corresponding apertures, respectively; and an internal shielding including a circumferential section for shielding the cavity and means for retaining the holding shell in position in the housing.

11. A retention assembly for use with a filtered connector including a housing enclosing a plurality of capacitors and defining a cavity therein, comprising:

a holding shell adapted to be inserted into the housing of the connector, said holding shell including a lower horizontal section for engagement with said plural capacitors in the housing of the connector; and an internal shielding including a generally circumferential section for shielding said cavity of the housing of the connector; wherein the internal shielding abuts against the holding shell for retaining the holding shell in position with regard to the housing of the connector.

12. The assembly as defined in claim 11, wherein the internal shielding has a plurality of latching means for retaining the internal shielding in position with regard to the housing of the connector.

13. The assembly as defined in claim 11, wherein the holding shell further includes a plurality of upper horizontally extending sections for mechanical and electrical engagement with a rearward extension of the internal shielding.

14. A hollow holding shell adapted to cooperate with an internal shield for use within a filtered connector having a cavity therein, comprising:

a vertical section defining an opening generally in alignment with said cavity of the connector, and having means for abutment with said internal shielding;

a lower horizontally extending section integrally extending rearward from a lower edge of said vertical section for engagement with capacitors of the filtered connector; and at least one upper horizontally extending section integrally extending rearward from an upper edge of said vertical section for mechanical and electrical engagement with a rearward extension of said internal shielding.

15. An internal shielding adapted to cooperate with a holding shell for use within a filtered connector having a housing defining a cavity therein, comprising:

a circumferential section for shielding the cavity;

at least one rearward extension integrally from a rear portion of the circumferential section, and said rearward extension including a lance for engagement with a rear portion of the housing of the connector; and at least one backward folded tip formed on a front portion of the circumferential section, whereby by means of the cooperation of the lance and the tip, the shielding can be secured to the housing without relative movement in a front-to-end direction.

16. The internal shielding as defined in claim 15, wherein a plurality of tangs integral extend inwardly from the circumferential section and into the cavity of the housing.

17. The internal shielding as defined in claim 16, wherein a plurality of guiding leaves are formed on the front portion of the circumferential section.

18. A semi-finished filtered connector assembly, comprising:

an insulative housing defining a cavity therein;

a plurality of horizontal passageways disposed lengthwise in the housing for receiving a corresponding number of contacts therein;

a plurality of vertical apertures upward extending from an under-surface of the housing corresponding to and communicative to the corresponding passageways, respectively, for receiving therein a corresponding number of capacitors wherein a first end of each of said capacitors abuts against the corresponding contact;

a holding shell including at least a lower horizontal section adapted to be inserted into a slit under said apertures in the housing wherein the lower horizontal section upward presses against a second end of each of said capacitors for holding each of said capacitors in position in the corresponding apertures, respectively.

* * * * *